US007596334B2

(12) United States Patent
Yoshino et al.

(10) Patent No.: US 7,596,334 B2
(45) Date of Patent: Sep. 29, 2009

(54) IMAGE FORMING APPARATUS

(75) Inventors: Daisuke Yoshino, Kanagawa (JP); Toshiyuki Miyata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/806,801

(22) Filed: Jun. 4, 2007

(65) Prior Publication Data

US 2008/0112738 A1 May 15, 2008

(30) Foreign Application Priority Data

Nov. 14, 2006 (JP) ..... P2006-308212

(51) Int. Cl.
*G03G 15/20* (2006.01)

(52) U.S. Cl. ..... 399/67; 399/68; 399/122; 399/329

(58) Field of Classification Search ..... 399/67, 399/68, 122, 329
See application file for complete search history.

(56) References Cited

U.S. PATENT DOCUMENTS 5,241,348 A * 8/1993 Garavuso et al. ..... 399/322
5,323,216 A * 6/1994 Mahoney ..... 399/45
6,246,858 B1 6/2001 Condello et al.
2005/0271432 A1 12/2005 Chiba

FOREIGN PATENT DOCUMENTS

| | | |
|---|---|---|
| JP | 3-133871 | 6/1991 |
| JP | 5-173445 | 7/1993 |
| JP | 2000-347528 | 12/2000 |
| JP | 2003-5566 | 1/2003 |

* cited by examiner

*Primary Examiner*—David M Gray
*Assistant Examiner*—Bryan P Ready
(74) *Attorney, Agent, or Firm*—Morgan, Lewis & Bockius LLP

(57) ABSTRACT

An image forming apparatus, includes: a first fusing member provided rotatably; a second fusing member disposed rotatably in press contact with the first fusing member, so as to define, together with the first fusing member therebetween, a nip section through which a recording material which holds an image thereon is to be passed; and a changing unit that changes an angle formed by the nip section and a transport direction of the recording material which is passed through the nip section.

11 Claims, 7 Drawing Sheets

IMAGE FORMING APPARATUS

CROSS-REFERENCE TO RELATED APPLICATION

This application is based on and claims priority under 35 USC 119 from Japanese Patent Application No. 2006-308212 filed Nov. 14, 2006.

BACKGROUND

1. Technical Field

The present invention relates to an image forming apparatus such as a photocopier and a printer.

2. Related Art

In an image forming apparatus such as a photocopier and a printer, there sometimes occurs a case, for example, in which a fusing unit is provided in which a recording member on which an image such as a toner image is held is heated and pressurized so as to fuse the image so held on to the recording material.

SUMMARY

According to an aspect of the invention, there is provided an image forming apparatus, including: a first fusing member provided rotatably; a second fusing member disposed rotatably in press contact with the first fusing member, so as to define, together with the first fusing member therebetween, a nip section through which a recording material which holds an image thereon is to be passed; and a changing unit that changes an angle formed by the nip section and a transport direction of the recording material which is passed through the nip section.

BRIEF DESCRIPTION OF THE DRAWINGS

Exemplary embodiments of the present invention will be described in detail based on the following figures, wherein.

DETAILED DESCRIPTION

Hereinafter, an embodiment of the invention will be described by reference to the accompanying drawings.

Figure 1:
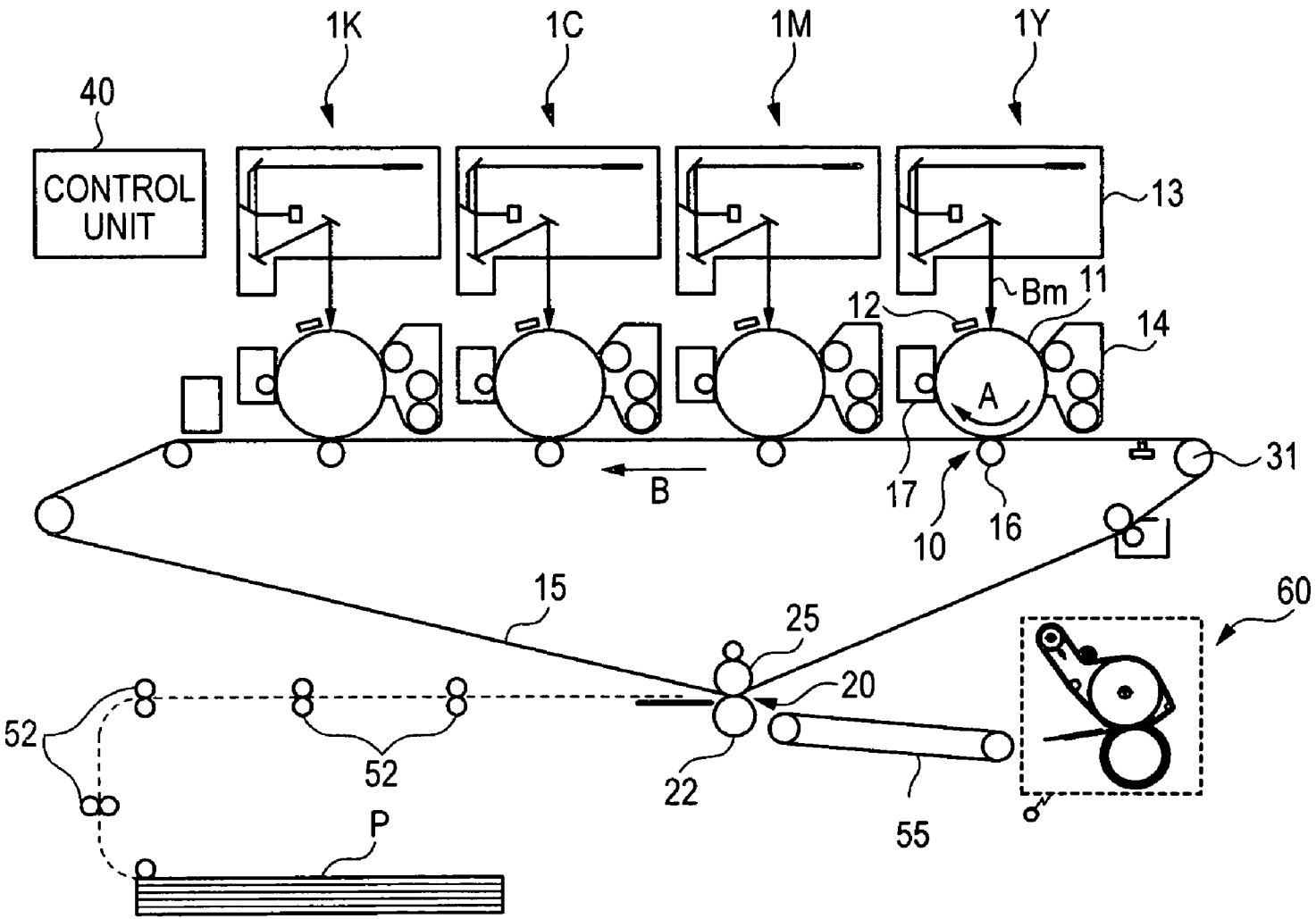
FIG. 1 illustrates a schematic diagram showing the configuration of an image forming apparatus to which the invention is applied.

FIG. 1 is a schematic drawing which shows the configuration of an image forming apparatus to which the invention is applied. This image forming apparatus is an intermediate transfer image forming apparatus which is generally referred to as a tandem type image forming apparatus. In this image forming apparatus, a plurality of image forming units 1Y, 1M, 1C, 1K in which toner images of respective color components are formed by means of an electrophotography method. In addition, primary transfer sections 10 are provided, respectively, in the image forming units 1Y, 1M, 1C, 1K, where toner images of the respective color components are sequentially transferred to an intermediate transfer belt 15 (a primary transfer).

Furthermore, in this image forming apparatus, a secondary transfer section 20 is provided where superposed toner images which are transferred on to the intermediate transfer belt 15 are transferred on to a sheet of paper P which is a recording material (a recording sheet of paper) altogether at one time (a secondary transfer). In addition, various types or rollers including a drive roller 31 are provided inside the intermediate transfer belt 15 which stretch the intermediate transfer belt 15 from the inside thereof and which are driven to rotate by a motor (not shown) which has a superior constant speed characteristic and the like. Furthermore, a fusing unit 60 is provided for fixing or fusing the secondarily transferred images on to the sheet of paper P. In addition, a control panel (not shown) which receives inputs from a user regarding the number of sheets on which images are formed, thickness and basic weight of sheets and types of sheets on which images are formed and a control unit 40 for controlling operations of constituent units (sections) of the image forming apparatus are provided.

In this embodiment, the following electrophotographic devices are sequentially provided in each of the image forming units 1Y, 1M, 1C, 1K. Firstly, a charge device 12 for charging a photoconductor drum 11, which rotates in a direction indicated by an arrow A, is provided on the periphery of the photoconductor drum 11. In addition, a laser exposure device 13 (in the figure, an exposure beam is denoted by reference character Bm) for writing a latent image on the photoconductor drum 11 is provided. Furthermore, a developing device 14 is provided which accommodates a color component toner and visualizes a latent image on the photoconductor drum 11 with the toner. In addition, a primary transfer roller 16 is provided which transfers the formed or visualized color component toner image to the intermediate transfer belt 15 at the primary transfer section 10. Additionally, a drum cleaner 17 is provided which removes the toner which remains on the photoconductor drum 11.

The primary transfer section 10 is configured to include the primary transfer roller 16 which is disposed in such a manner as to face oppositely the photoconductor drum 11 across the intermediate transfer belt 15.

The secondary transfer section 20 is made up of a secondary transfer roller 22 which is disposed on a toner image holding surface side of the intermediate transfer belt 15 and a backup roller 25. The secondary transfer roller 22 is disposed in press contact with the backup roller 25 across the intermediate transfer belt 15 or with the intermediate transfer belt 15 interposed therebetween.

The control unit 40 includes a CPU (Central Processing Unit) for controlling operations of the respective devices (the respective sections), a ROM (Read Only Memory) in which a program is recorded, a RAM (Random Access Memory) for temporarily storing various types of data and the like. In addition, the control unit 40 not only controls the operations of the respective devices (the respective sections) as has been described above but also counts sheets on which images are to be formed and determines types of sheets on which images are to be formed based on inputs made by the user through the control panel (not shown).

Next, a basic image creating process of the image forming apparatus according to the exemplary embodiment will be described. In the image forming apparatus according to the exemplary embodiment, image data is outputted from an image reading apparatus or the like, not shown. Then, a predetermined image processing is applied to the image data so outputted by an image processing apparatus, not shown, so as to be converted into color material gradation data of four colors such as Y (yellow), M (magenta), C (cyan), and K (black) to thereby be outputted to the laser exposure device 13.

The laser exposure device 13 emits an exposure beam Bm from, for example, a laser semiconductor to be shone on to the photoconductor drum 11 of each of the image forming units 1Y, 1, 1C, 1K according to the color material gradation data inputted thereinto. A surface of each photoconductor drum 11 is charged by the charge device 12, and thereafter, the charged surface is scan exposed by the laser exposure device 13 so as to form a latent image thereon.

The latent images so formed are then developed as toner images of the respective colors of Y, M, C, K by the respective developing devices 14 in the image forming units 1Y, 1M, 1C, 1K.

On the other hand, the intermediate transfer belt 15 is driven to circulate in the image forming apparatus at a predetermined speed in a direction indicated by an arrow B shown in FIG. 1 by means of the various types of rollers including the drive roller 31. The toner images formed on the photoconductor drum 11 are sequentially attracted to the intermediate transfer belt 15 in an electrostatic fashion at the primary transfer sections 10 where the respective photoconductor drums 11 come into abutment with the intermediate transfer belt 15, whereby toner images are formed on the intermediate transfer belt 15 which are superposed one on another. After the images are formed on the intermediate transfer belt in the superposed fashion, the intermediate transfer belt 15 moves, so that the toner images are transported to the secondary transfer section 20. At the secondary transfer section 20, the secondary transfer roller 22 is pressed by the backup roller 25 via the intermediate transfer belt 15. As this occurs, a sheet of paper P is transported to the secondary transfer section 20 in synchronism with the arrival of the intermediate transfer belt 15 holding the toner images thereon so as to be held between the intermediate transfer belt 15 and the secondary transfer roller 22.

At the secondary transfer section 20, a secondary transfer bias is applied between the secondary transfer roller 22 and the backup roller 25, so as to form a secondary transfer electric field between the two members. Then, the images held on the intermediate transfer belt 15, which have not yet been fixed or fused, are electrostatically transferred to the sheet P altogether at the secondary transfer section 20. Thereafter, the sheet P on to which the toner images have electrostatically been transferred is transported by the secondary transfer roller 22 to a transport belt 55 which is provided on a downstream side of the secondary transfer roller 22 in a sheet transport direction. The transport belt 55 transports the sheet P to the fusing unit 60 at an optimum speed. In the fusing unit 60, the sheet P which holds the transferred toner images is heated and pressurized so as to fuse the toner images on the sheet P. Then, the sheet P, on which the image fusing has been completed, is discharged to the outside of the image forming apparatus.

Next, the fusing unit 60 will be described.

Figure 2:
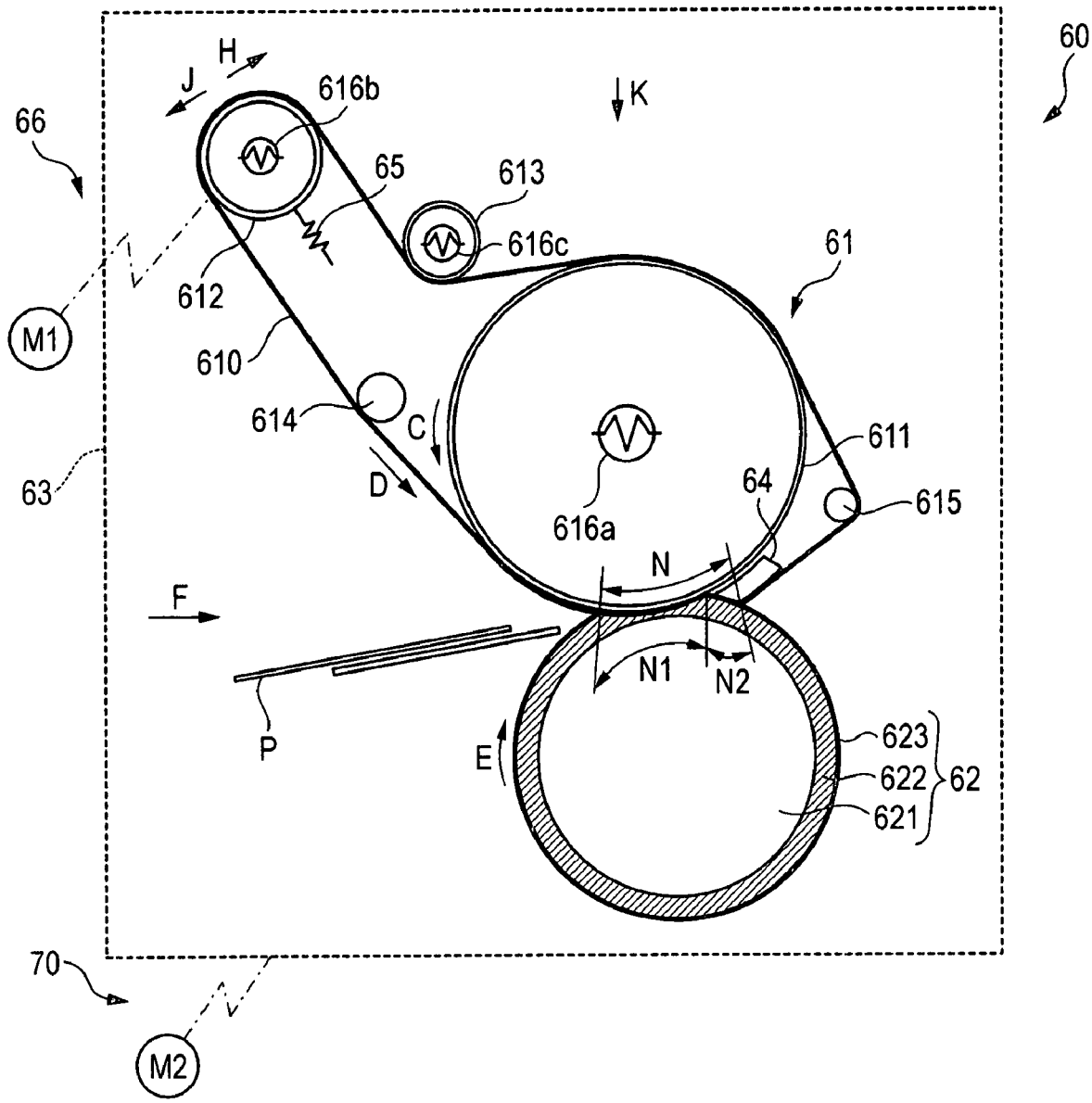
FIG. 2 illustrates a side sectional view showing schematically the configuration of a fusing unit to which the invention is applied.

FIG. 2 is a side sectional view which shows schematically the configuration of the fusing unit 60 to which the invention is applied. This fusing unit 60 is made up mainly of a fusing belt module 61, an impression roller 62 which is disposed in press contact with the fusing belt module 61 and a support housing 63 as a support member which supports the fusing belt module 61 and the impression roller 62. In addition, although the description was omitted in FIG. 1, a rotating unit 70 for rotating the whole fusing unit 60 via the support housing 63 is provided on a main body (not shown) side of the image forming apparatus.

The fusing belt module 61 includes a fusing belt 610 and a fusing roller 611 as a first fusing member. The fusing belt 610 is provided in such a manner as to rotate or move in circles, and the fusing roller 611 is provided rotatably and has a function to stretch the fusing belt 610.

In addition, the fusing belt 610 has downstream of the fusing roller 611 in a rotational direction of the fusing belt 610 an external heating roller 613 for stretching the fusing belt 610 from the outside thereof and heating the fusing belt 610 from the outside thereof.

Furthermore, the fusing belt module 61 has downstream of an area where the fusing roller 611 and the impression roller 62 are in press contact with each other via the fusing belt 610 and in a position lying in the vicinity of the fusing roller 611 a release pad 64 for pressing the fusing belt 610 against the impression roller 62. As a result, a nip section N where toner images are fused on a recording material is formed in the area where the fusing belt module 61 and the impression roller 62 are press contact with each other.

The fusing module 61 includes an idler roller 615 which stretches the fusing belt 610 downstream of the nip section N and a drive source (not shown) such as a motor for rotationally driving the fusing roller 611. Furthermore, the fusing belt module 61 includes a heater 616*a* as a heat source for heating the fusing roller 611 in an interior of the fusing roller 611. Moreover, the fusing belt module 61 includes in an interior of the external heat roller 613 a heater 616*c* as a heat source for heating the external heat roller 613. In addition, the fusing belt module 61 includes a steering roller 612 which not only stretches the fusing belt 610 from the inside thereof but also adjusts the position of the fusing belt 610 in a direction which intersects the rotational direction of the fusing belt 610 (a direction which intersects substantially at right angles to the rotational direction of the fusing belt 610, a width direction of the fusing belt 610).

Furthermore, the fusing belt module 61 includes a sensor (not shown) for detecting the position of the fusing belt 610 in the direction which intersects the rotational direction of the fusing belt 610. In addition, the fusing belt module 61 includes in an interior of the steering roller 612 a heater 616*b* as a heat source for heating the steering roller 612. Furthermore, the fusing belt module 61 includes a tensioner 65 for pushing the steering roller 612 towards the outside of the fusing belt 610 so as to impart a predetermined tension to the fusing belt 610. In addition, the fusing belt module 61 includes a shifting unit 66 which shifts one end portion side of the steering roller 612 so as to impart an inclination or tilt to the steering roller 612.

The fusing belt 610 is a flexible endless belt. In addition, this fusing belt 610 is formed into a three-layer construction and is made up of a base layer which is made from a polyimide or the like and which has a thickness of the order of 80 μm, an elastic layer which is made from a silicone rubber or the like and is laminated on a front surface side (an outer circumferential surface side) of the base layer and a surface layer (a release layer) which is formed from a fluorine-based resin and which has a thickness of the order of 30 μm, the surface layer being formed in such a manner as to cover the elastic layer.

On the other hand, the fusing roller 611 has no elastic layer which covers the fusing roller 611 and is a hard roller which is made up by coating a surface of a core metal (a core roller) of aluminum with a heat-resistant resin (a fluorine plastic).

The release pad 64 as a pressurizing member is a member which is formed into a thin plate-like shape of, for example, a SUS metal or resin and is also a member which is formed into an arc-like shape in section. The release pad 64 is provided downstream and in the vicinity of an area (a roller nip section N1) where the impression roller 62 and the fusing roller 611 are brought into press contact with each other via the fusing belt 610. In addition, the release pad 64 is provided on a rear surface side of the fusing belt 610 and is set in such a manner as to pressurize uniformly the impression roller 62 via the fusing belt 610 with a predetermined load over a predetermined width region on the impression roller 62. As a result, a "release pad nip section N2" is formed within the nip section N in such a manner as to be continued from the roller nip section N1.

The steering roller 612 is provided in such a manner as to be shifted obliquely upwards (refer to an arrow H in the figure) and obliquely downwards (refer to an arrow J in the figure) as viewed in the figure atone end portion thereof. Then, the steering roller 612 is provided in such a manner as to be tilted due to the one end portion side thereof being shifted in the oblique directions.

The shifting unit 66 changes the position (alignment) of the steering roller 612 by so shifting the one end portion of the steering roller 612 so as to impart an inclination or tilt to the steering roller 612. The shifting unit 66 is made up of a drive source M1 such as a motor and a transmission mechanism for transmitting driving force from the drive source M1 to the steering roller 612. Note that cams, rack and pinion or the like are raised as making up the transmission mechanism.

In addition, in this exemplary embodiment, the shifting unit 66 is provided on the main body side of the image forming apparatus. Although the shifting unit 66 can be provided on a fusing unit 60 side of the image forming apparatus, since, in the event that the shifting unit 66 is so provided, the shifting unit 66 is also replaced when the fusing unit 60 is replaced, and this increases the replacement cost of fusing units 60. Then, in this exemplary embodiment, the configuration is adopted in which the shifting unit 66 is provided on the main body side of the image forming apparatus, so that even when fusing units 60 are replaced, the shifting unit 66 is allowed to remain on the main body side of the image forming apparatus.

The rotating unit 70 is made up of a drive source M2 such a motor and a transmission mechanism (not shown) for transmitting driving force from the drive source M2 to the support housing 63. Note that cams, rack and pinion or the like are raised as making up the transmission mechanism.

On the other hand, the impression roller 62 as a second fusing member is made up of, as a base material, a cylindrical roller 621 of aluminum or the like. In addition, an elastic layer 622 which is made from a silicone rubber or the like and which has a thickness of the order of 10 mm and a release layer 623 which is made from a tetrafluoroethylene-perfluoroalkyl vinyl ether copolymer (PFA) or the like and which has a thickness of the order of 100 μm are laminated on the base material sequentially in that order from the base material side, so as to form a soft roller.

In addition, the fusing unit 60 of the exemplary embodiment includes downstream of the nip section N a discharge sheet guide (not shown) for guiding a sheet which is discharged from the nip section N towards the outside of the fusing unit 60 and a posture correcting roller 614 for correcting the posture of the fusing belt 610 between the fusing roller 611 and the steering roller 612.

Furthermore, the fusing unit 60 will be described in detail.

Figure 3A:
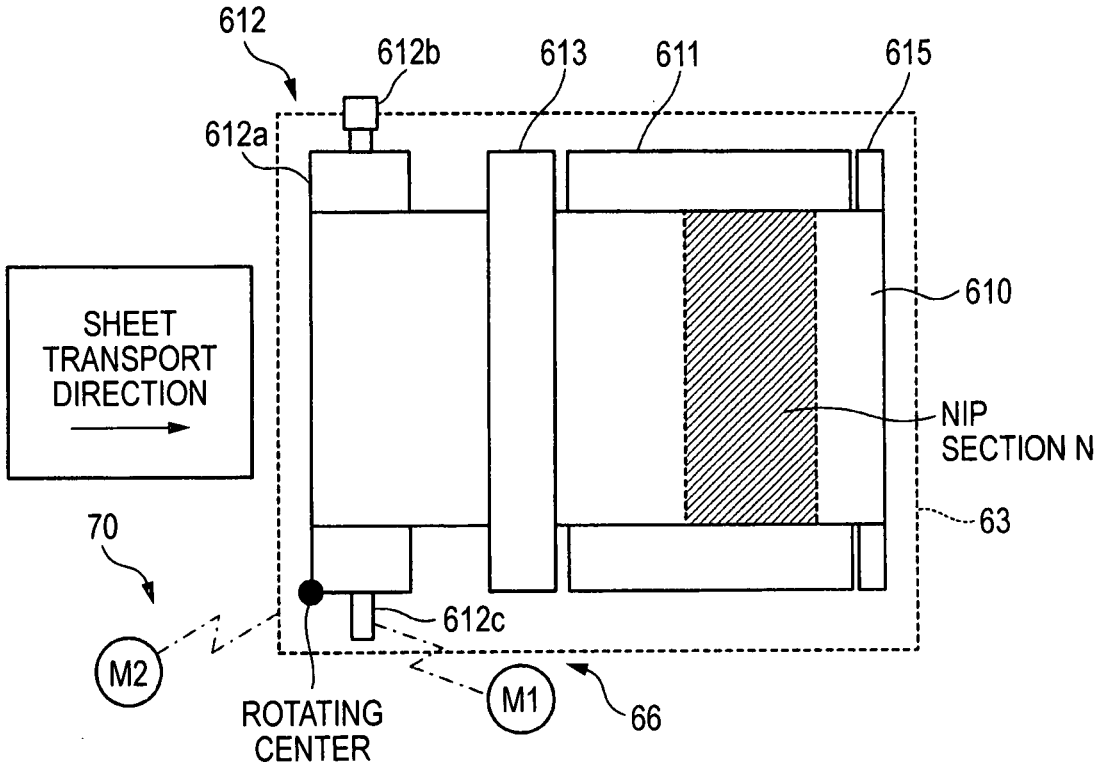
FIGS. 3A and 3B illustrate plan views of the fusing unit.
Figure 3B:
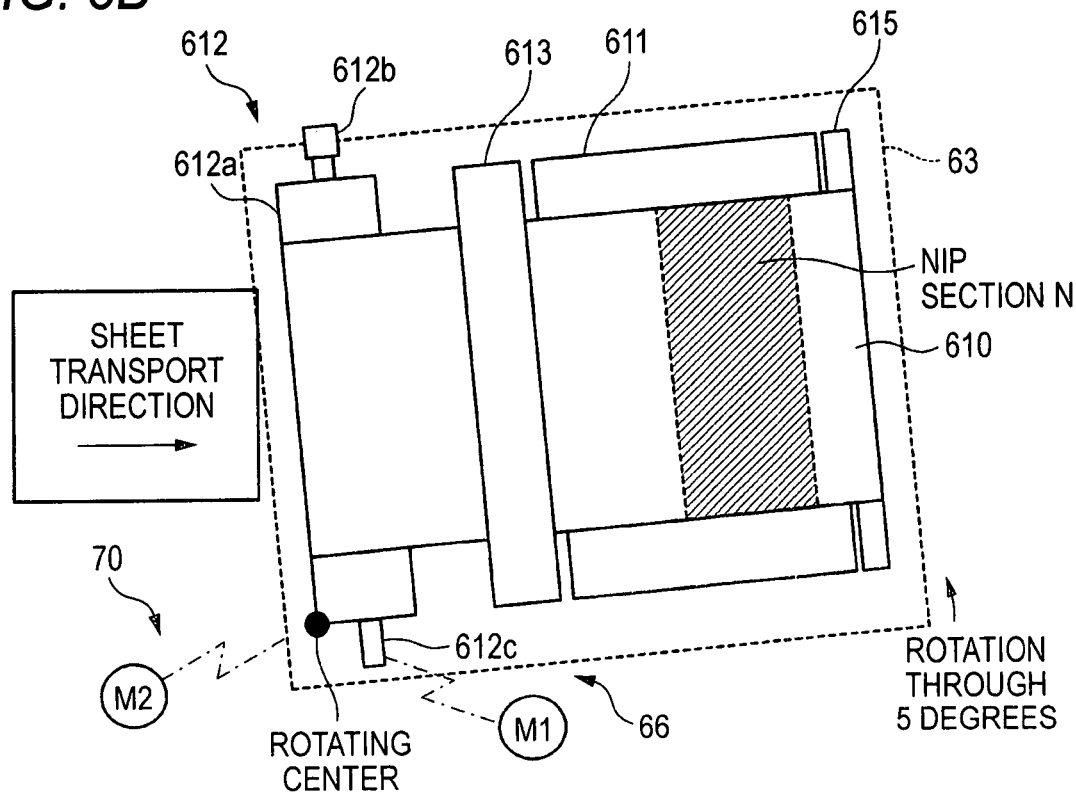

FIGS. 3A and 3B are plan views of the fusing unit 60. In this figure, the illustration of the release pad 64 and the posture correcting roller 614 is omitted.

As is shown in FIG. 3A, the steering roller 612 includes a main body portion 612*a* which stretches the fusing belt 610 and a receiving portion 612*c* which supports the main body portion 612*a* at the one end portion side thereof and receives driving force from the shifting portion 66. In addition, the steering roller 612 includes a support portion 612*b* which supports the main body portion 612*a* at the other end portion side of the main body portion 612*a* and which is supported by the support housing 63 of the fusing unit 60.

In addition, the support housing 63 is provided in such a manner as to rotate about a predetermined rotating center and is configured to rotate about the rotating center by receiving driving force from the rotating unit 70. This rotating center can be provided in an arbitrary position, and in this exemplary embodiment, a configuration is adopted in which the rotating center is disposed in the position of the end portion of the main body portion 612*a* of the steering roller 612. Then, when the rotating unit 70 is rotated from this position by the control unit 40, as is shown in FIG. 3B, the fusing unit 60 rotates, and the fusing roller 611 and the impression roller 62 also rotate (swing) to thereby change their positions (or be displaced). To be more specific, the fusing roller 611 and the impression roller 62 are displaced in such a manner that the nip section N approaches a transport direction of sheets at one end thereof. In addition, FIG. 3B shows a state in which the support housing 63 is rotated counterclockwise through 5 degrees by the rotating unit 70.

As a result of this, the nip section N, which is provided in such a manner as to intersect the transport direction of sheets which are transported by the transport belt 55 (refer to FIG. 1) substantially at right angles (refer to FIG. 3A), is now disposed in a non-perpendicular state relative to the sheet transport direction. Looking at this from a different viewpoint, while in FIG. 3A, an angle formed by an end portion of a sheet in a direction which intersects the sheet transport direction (the direction which intersects the sheet transport direction substantially at right angles, the width direction of the sheet) and an entrance of the nip section N is substantially a right angle, in FIG. 3B, the angle formed in the way described above becomes an acute angle (an obtuse angle). In addition, in this embodiment, a changing unit for changing the angle formed by the nip section N and a sheet that is to be passed through the nip section N is configured by the control unit 40 (refer to FIG. 1) and the rotating unit 70. In addition in this exemplary embodiment, a swing unit for swinging at least one end side of the nip section N relative to the sheet transport direction is configured by the control unit 40 and the rotating unit 70.

Hereinafter, in this specification, the state in which the nip section N is substantially at right angles to the sheet transport direction, as is shown in FIG. 3A, is referred to as a "reference state," whereas the state in which the nip section N is not at right angles to the sheet transport direction is referred to as a "non-reference state."

Next, the operation of the fusing unit 60 will be described using FIGS. 2, 3A and 3B.

When fusing is performed in the fusing unit 60, firstly, a sheet of paper P on which toner images are held is introduced into the nip section N by the transport belt 55 (refer to FIG. 1). As this occurs, receiving driving force from the drive source (not shown), the fusing roller 611 is rotating in a direction indicated by an arrow C. In addition, as the fusing roller 611 is rotating, following the fusing roller 611, the fusing belt 610 is moving in circles or rotating in the direction indicated by the arrow C. When fusing is performed, the heaters 616*a* to 616*c* are fed by a power supply unit, not shown, whereby the fusing roller 611, the steering roller 612 and the external heating roller 613 are controlled to be heated to a predetermined temperature.

In this state, the sheet P introduced into the nip section N is transported in a downstream direction by the fusing belt 610 and the impression roller 62 and passes sequentially through the roller nip section N1 and the release pad nip section N2. Then, in the processes where the sheet P passes through the roller nip section N1 and the release pad nip section N2, the sheet P is pressurized and heated by the fusing belt 610 and the impression roller 62. As a result, the toner images are fused on the sheet P. Then, the fusing belt 610 which has passed through the release pad nip section N2 continues to move along a side surface of the release pad 64.

Then, the traveling direction of the fusing belt 610 is changed drastically so as to be bent towards the idler roller 615. Because of this, the sheet P, which has been pressurized and heated at the nip section N, cannot follow the change in the traveling direction of the fusing belt 610 at a point in time at which the sheet P has emerged from the nip section N. As a result of this, the sheet P is separated from the fusing belt 610 by virtue of a so-called "nerve" of its own (self-stripping). Separation of curvature is performed stably in this way at an exit portion of the nip section N. The sheet P which is separated from the fusing belt 610 is, thereafter, discharged to the outside of the image forming apparatus by the discharge sheet guide (not shown) and a discharge sheet roll (not shown), ending the fusing process.

Incidentally, there sometimes occurs a case where the fusing belt 610, fusing roller 611 and idler roller 615 are not molded properly. In addition, there sometimes occurs a case where the roller members such as the fusing roller 611, idler roller 615, external heating roller 613 and the like are not held in parallel. In these cases, there sometimes occurs a case where the fusing belt 610 is not transported accurately along the predetermined path and moves (walks) towards one of directions which intersect the traveling direction of the fusing belt 610. Then, this moving distance is increased, wrinkles or the like are generated in the fusing belt 610 and sheets, leading to a problem that a stable fusing performance cannot be secured. Because of this, in this exemplary embodiment, in order to prevent the excessive movement of the fusing belt 610, a process is adopted in which an end position of the fusing belt 610 is detected by a sensor (not shown), so that the steering roller 612 is tilted appropriately based on the result of such a detection.

For example, in FIG. 3A, when the control unit 40 determines based on an output from the sensor (not shown) that the fusing belt 610 is being situated further downwards than the predetermined position as viewed in the figure (towards the receiving portion 612*c*), the control unit 40 causes the shifting unit 66 to shift the receiving portion 612*c* obliquely downwards (in the direction indicated by the arrow J in FIG. 2) by a predetermined amount, so as to impart an inclination or tilt of a predetermined angle to the steering roller 612. When such a tilt is imparted to the steering roller 612 the fusing belt 610 moves along the steering roller 612 so tilted. As a result, the fusing belt 610 moves upwards as viewed in the figure (in a direction in which the belt moves away from the receiving portion 612*c*).

On the other hand, when the above state, that is, the state in which the receiving portion 612*c* is situated downwards is maintained, the fusing belt 610 moves gradually upwards as viewed in the figure. Then, when the control unit 40 determines based on an output from the sensor (not shown) that the fusing belt 610 is has moved to be situated further upwards than the predetermined position as viewed in the figure, the control unit 40 causes the shifting unit 66 to shift the receiving portion 612*c* of the steering roller 612 obliquely upwards (in the direction indicated by the arrow H in FIG. 2) by a predetermined amount, whereby the moving direction of the fusing belt 610 is reversed, and the fusing belt 610 moves gradually downwards as viewed in the figure. The, when the fusing belt 610 has moved to be situated further downwards than the predetermined position as viewed in the figure, the control unit 40 causes the shifting unit 66 to move the receiving portion 612*c* of the steering roller 612 obliquely downwards by the predetermined amount, so as to change again the tilt angle of the steering roller 612. Namely, in this embodiment, the angle of the steering roller 612 is changed by swinging the receiving portion 612*c* in the oblique directions repeatedly, so that the fusing belt 610 is allowed to move (walk) in the directions which intersect the rotational direction of the fusing belt 610 within a predetermined range.

Incidentally, with a conventional fusing unit, there is caused a problem that an edge portion (an end portion) or edge portions of a sheet (hereinafter, referred to as a "sheet edge portion") is brought into press contact with fusing members, whereby a mark or wear is caused in the fusing members, and an image defect (failure) is eventually caused in a resulting image fused by the fusing members. This will be described below.

Figure 4B:
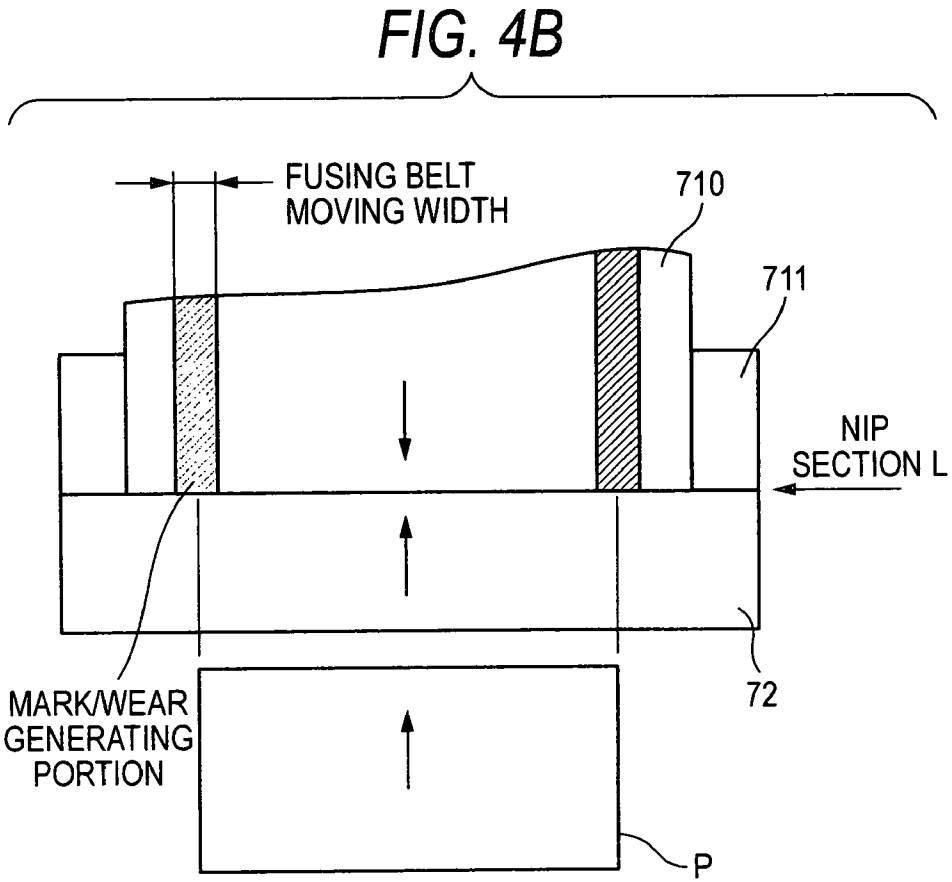
FIGS. 4A and 4B illustrate diagrams explaining a conventional fusing unit.
Figure 4A:
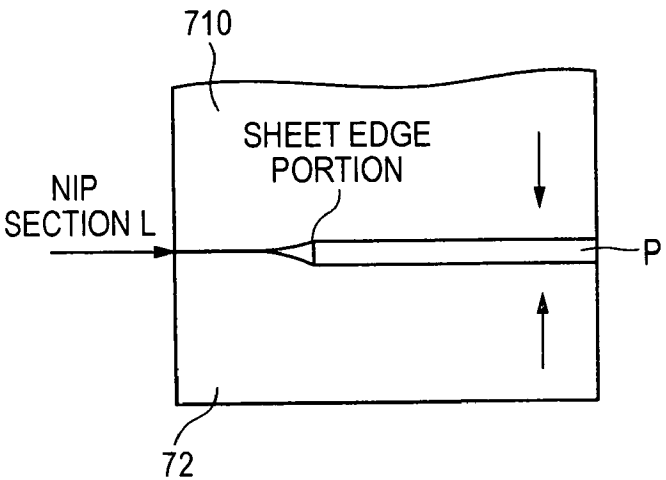

FIGS. 4A and 4B are drawings which describes a conventional fusing unit. As is shown in FIG. 4B, the fusing unit includes a fusing belt 710 which is provided in such a manner as to move in circles or rotate, a cylindrical fusing roller 711 which stretches the fusing belt 710 and an impression roller 72 which is disposed in such a manner as to be press contact with the fusing roller 711 via the fusing belt 710. In addition, the fusing belt 710 is formed into an endless shape. Additionally, a nip section L is formed between the fusing belt 710 and the impression roller 72 for fusing toner images on a sheet of paper on thereto. The image forming apparatus also includes a plurality of tension rollers (not shown) which stretch the fusing belt 710, a drive motor (not shown) for rotating the fusing roller 711, a heat source (not shown) for heating the fusing roller 711 and the like.

In the fusing apparatus shown in the figure, a sheet passes through the nip section L in such a state that toner images are held on a side thereof which faces the fusing belt 710, whereby the toner images are fused on to the sheet. Furthermore, the fusing apparatus also includes a roller-like member (not shown) which is similar to the steering roller 612 shown in FIGS. 2, 3A and 3B a shifting unit (not shown) for shifting one end of the roller-like member, whereby the fusing belt 710 is configured to be shifted in directions which intersect a rotational direction of the fusing belt 710 by tilting the roller-like member by the shifting unit.

On the other hand, FIG. 4A is an enlarged view of part of FIG. 4B. This figure illustrates a state occurring in the vicinity of the sheet edge portions in such a state that the sheet P is situated in the nip section L. When the sheet P is inserted into the nip section L, the sheet edge portions are brought into strong contact with the fusing belt 710. In addition, the sheet edge portions are also brought into strong contact with the impression roll 72. As a result, a mark or wear is caused in the fusing belt 710 and the impression roller 72.

In addition, as is shown in FIG. 4A, when the sheet P is inserted into the nip section L, the fusing members are deformed due to the existence of the sheet P, and the traveling (rotating) speed of the fusing member is caused to differ depending upon positions thereon. In this fusing apparatus, since the fusing roller 711 is formed into the cylindrical shape, the fusing belt 710 is configured to have a constant rotational radius at the nip section L to thereby travel along the circumference of the fusing roller 711 at a constant speed. When the sheet is passed through the nip section L, however, as is shown in the figure, the fusing belt 710 is caused to be recessed at a portion where the fusing belt 710 is brought into contact with the sheet P, whereas the fusing belt 710 is left in press contact with the impression roller 72 at a portion where the fusing belt 710 is not in contact with the sheet P. Because of this, there is caused a difference in outside diameter in the fusing belt 710, and a speed at the portion on an outer circumferential surface of the fusing belt 710 where the belt is in contact with the sheet P becomes slower than a speed at the portion where the fusing belt 710 is not in contact with the sheet P. Then, in the event that the difference in speed in a width direction of the fusing belt 710 in this way, the fusing belt 710 and the sheet P come to slide on each other, whereby there may occur a case where wear is generated in the fusing belt 710.

Furthermore, the fusing unit is configured to be shifted in the directions which intersect the rotational direction of the fusing belt 710 by tilting the roller-like member as has been described before. As a result, as is shown in FIG. 4B, a mark or wear is generated at both edge portions of the fusing belt 710 within a moving width (a waking width) over which the fusing belt 710 moves (in the figure, indicated as a "mark/wear generating portion").

Then, when the mark or wear is generated in the fusing belt 710 and the impression roller 72 in the way described above, there is a fear that the lives of the fusing belt 710 and the impression roller 72 may be reduced. In addition, when the mark or wear is generated in the fusing belt 710, since the fusing belt 710 is brought into contact with the toner images on the sheet, there is a fear that an image defect such as irregularity in gloss of the toner images that are fused may be generated. In particular, when the fusing belt 710 is configured to move in the directions which intersect the rotational direction of the fusing belt 710 as has been described above, there is a fear that a gloss irregularity in the form of a strip may be generated in the toner images that are fused.

In addition, although the fusing belt 710 is used in the fusing unit, there is also known a fusing unit adopting a so-called roll-nip method in which no fusing belt 710 is used.

This roll-nip method adopting fusing unit is made up of a pair of roller-like members, and no belt-like member such as the fusing belt 710 exists. Therefore, it is natural that the moving (walking) of the fusing belt 710 does not occur. As a result, sheets pass through substantially the same place on the roller-like members. Because of this, marks or wear that is generated on the roller-like members by sheet edge portions of the sheets tends to be formed in such a manner as to be collected to a specific location and deeply when compared to a case where a belt-like member is used in such a manner as to be allowed to move (walk). Because of this, irregularities come to be generated more conspicuously in a fused image, and the lives of the roller-like members are also reduced.

In addition, there sometimes occurs a case where a surface layer (a release layer) made from a fluorine-based resin is formed on the surface of the fusing belt 710. When a fluorine-based resin is used as a surface material for the fusing belt 710, there is provided an advantage that since the relevant resin provides good releasability, toner images become easy to be released without using oil. However, the fluorine-based resin is less elastic than the silicone rubber or the like which has been conventionally used as a release material, and there sometimes occurs a case where a recess or mark is generated on the surface of the fusing belt 710 by a single passage of a sheet of thick paper between the fusing belt 710 and the impression roller 72. When printing (fusing), in particular, a document or picture or the like which has a high image density on to a sheet of paper, the mark appears as a linear defect in the resulting image.

Here, the mark/wear generating portion describe by use of FIG. 4B will be described in greater detail.

Figure 5A:
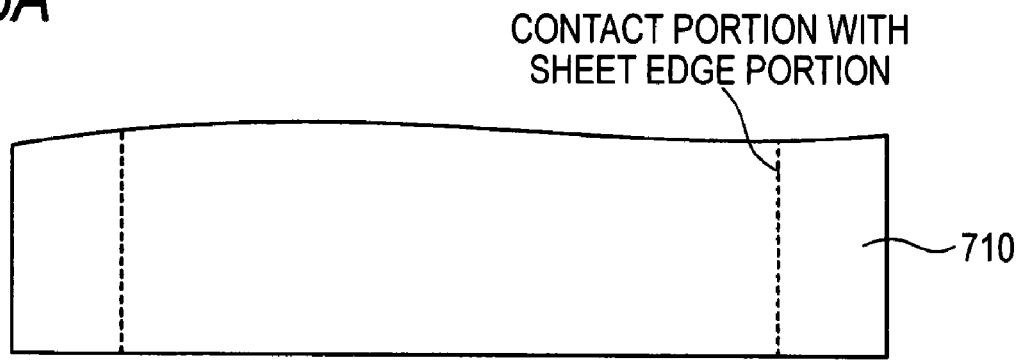
FIGS. 5A to 5D illustrate explanatory diagrams illustrating a state of a fusing belt shown in FIG. 4B.
Figure 5B:
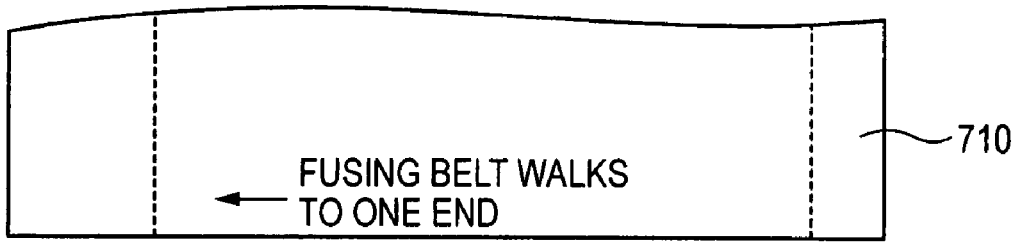

FIGS. 5A to 5B show explanatory diagrams which illustrate the state of the fusing belt 710 shown in FIG. 4B. When a sheet is inserted into the nip section L in the fusing unit shown in FIG. 4B, the fusing belt 710 and the sheet edge portions come into contact with each other as has been described above.

FIG. 5A illustrates a state in which the fusing belt 710 is situated substantially in an axially central portion of the fusing roller 711 (refer to FIG. 4B). In the state shown in the figure, when the sheet is passing through the nip section L (refer to FIGS. 4A and 4B), the sheet edge portions come into contact with both the end portions of the fusing belt 710. Note that contact portions of the fusing belt 710 where the fusing belt 710 is brought into contact with the sheet edge portions are indicated by broken lines.

FIG. 5B illustrates a state in which the fusing belt 710 moves (walks) towards one end of the fusing roller 711. When the sheet passes through the nip section L in the state shown in the same figure, the sheet edge portions come into contact with the fusing belt 710 in positions which deviate towards the other end of the fusing roller 711.

Figure 5C:
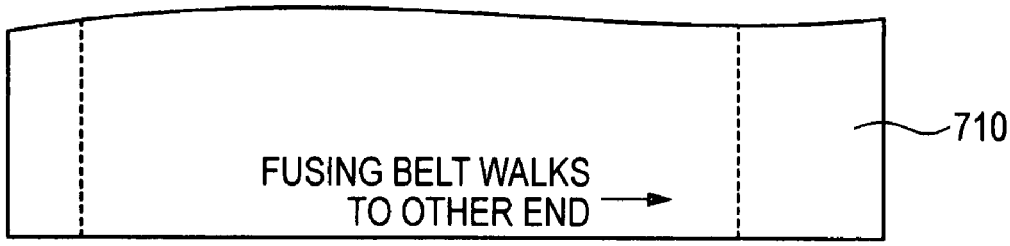

FIG. 5C illustrates a state in which the fusing belt 710 moves (walks) towards the other end of the fusing roller 711. When the sheet passes through the nip section L in the state shown in the same figure, the sheet edge portions come into contact with the fusing belt 710 in positions which deviate towards the one end of the fusing roller 711.

Figure 5D:
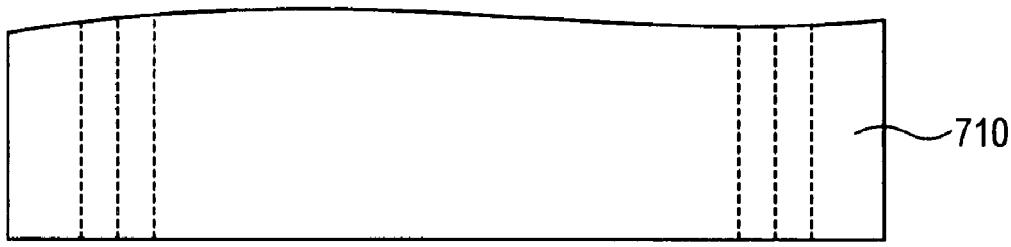

As a result, as is shown in FIG. 5D, a plurality of contact portions are formed where the fusing belt 710 comes into contact with the sheet edge portions, and a state results in which the plurality of contact portions are aligned parallel to each other. Then, in these contact portions, marks or wear is generated on the surfaces of the fusing belt 710 as has been described above.

When a fusing process is performed on other sheets in this state, since marks or wear is aligned parallel to each other in the contact portions, the aligned marks or wear appears as an image line on a fused image which is easy to be recognized by (or is standing out so as to be clearly visible to) the user or the like. In addition, as this occurs, since marks are collected to the same location to some extent, there is also caused a problem that the life of the fusing belt is reduced.

Then, there are some techniques for suppressing the generation of the problems attributed to the marks or wear. However, it is difficult to suppress the generation of the problems effectively even with those techniques. For example, there is proposed a technique in which a release agent such as oil is coated on a member corresponding to the fusing belt so as to protect the surface thereof. In this technique, the release agent so coated is transferred to a sheet of paper, and this leads to a problem that a defect in the form of a streak of oil tends to be easily generated on an image which results after fusing.

In addition, there is also proposed a technique in which a fusing unit and a transport unit for transporting sheets to the fusing unit are disposed askew to each other in advance so that sheets are inserted askew relative to the fusing unit so as to widen the width of wear on a fusing member which is caused by sheet edge portions. In the case of this technique, however, since sheets are inserted askew into the fusing units at all times, there is caused a problem that when fusing is performed on thin sheets, wrinkles or the like are easily generated thereon.

Furthermore, similar to the configurations shown in FIGS. 4A to 5D, there is proposed a technique in which a fusing member is moved in directions which intersect the transport direction of sheets that are transported substantially at right angles so that the width of wear caused on the fusing member by sheet edge portions is widened so as to extend the life of the fusing member. In this configuration, however, as has been described in FIGS. 5A to 5D, since marks are formed in such a manner as to be aligned substantially parallel to the transport direction of sheets, the marks appear in the form of an image line which is easily recognized by the user or the like on an image which results after fusing.

Then, in the embodiment of the invention, as is shown in FIGS. 1 to 3B, the configuration is adopted in which the fusing unit 60 is rotated by the rotating unit 70 so as to disperse marks caused on the fusing belt 610. Hereinafter, marks will be described which are generated on the fusing belt 610 when the fusing unit 60 is rotated by the rotating unit 70.

Figure 6A:
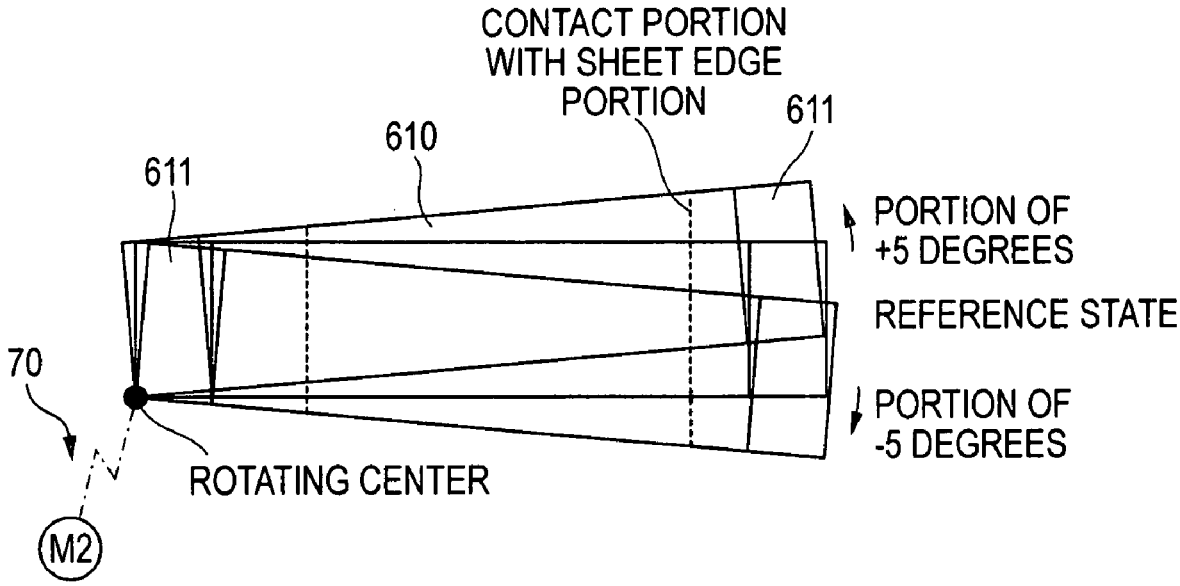
FIGS. 6A and 6B illustrate diagrams explaining marks or wear generated on a fusing belt when the fusing unit is caused to rotate.
Figure 6B:
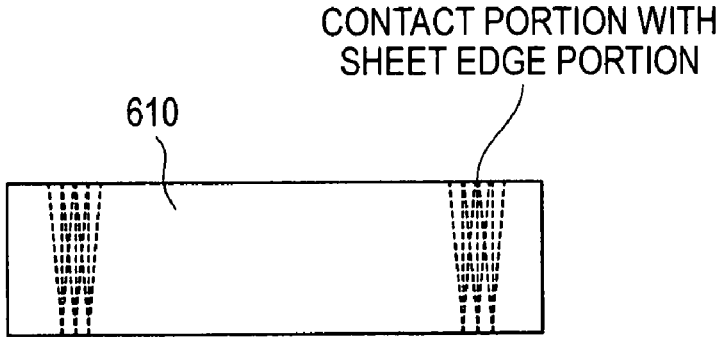

FIGS. 6A and 6B show diagrams which explain marks which are generated on the fusing belt 610 when the fusing unit 60 is rotated by the rotating unit 70.

FIG. 6A illustrates a state of the fusing roller 611 which results when the fusing unit 60 is viewed from a direction indicated by an arrow K in FIG. 2. Note that in this figure, the other members than the fusing roller 611 and the rotating unit 70 are omitted from illustration. In addition, FIG. 6B shows contact portions where the fusing belt 610 comes into contact with sheet edge portions.

In this exemplary embodiment, as is shown in FIG. 6A, the rotating center which constitutes a center about which the support housing 63 (refer to FIGS. 3A and 3B) rotates when it so does is provided at the one end portion of the fusing roller 611. In addition, in this exemplary embodiment, the support housing 63 is provided so as to rotate clockwise and counterclockwise about the rotating center. Then, the support housing 63 is rotated about the rotating center by the rotating unit 70. In addition, FIG. 6A illustrates three modes including a state in which the fusing roller 611 (the nip section N (refer to FIGS. 3A and 3B)) is disposed in the direction which intersects the transport direction of sheets that are transported (refer to FIGS. 3A and 3B) substantially at right angles (a reference state), a state in which the fusing roller 610 is rotated clockwise through 5 degrees about the rotating center (a non-reference state), and a state in which the fusing roller 610 is rotated counterclockwise through 5 degrees about the rotating center (a non-reference state).

Then, when sheets are passed through the nip section N in these three modes, respectively, sheet edge portions come into contact with the fusing belt 610 in different positions. In addition, in this embodiment, as has been described above, the steering roller 612 (refer to FIG. 2) is provided, and the fusing belt 610 moves in the directions which intersect the rotating direction of the fusing belt 610. As a result, as is shown in FIG. 6B, a plurality of contact portions are formed where the fusing belt 610 comes into contact with the sheet edge portions. In addition, since the nip section N is disposed so as to be put in the reference state and the non-reference states, these contact portions come to intersect each other, resulting in a state where the contact portions are dispersed further than the contact portions shown in FIG. 5.

In the examples shown in FIGS. 4A to 5D, since the fusing belt 710 is configured to simply be moved in the directions which intersect the rotating direction of the fusing belt 710 substantially at right angles, the contact portions where the fusing belt 70 comes into contact with the sheet edge portions are formed aligned parallel to each other as has been described above. As a result, as has been described above, when fusing is performed on other sheets of paper, the problem is caused that the image line which is easily recognized by the user of the like is easily generated. On the other hand, in the exemplary embodiment of the invention, since the fusing unit 60 is configured to be rotated, the contact portions can be disposed in the non-parallel state, and hence, marks or wear that is generated in the contact portions can be situated in a dispersed fashion.

The rotating center can be disposed at other locations on the fusing unit 60. Next, an example will be described in which the rotating center is provided substantially in a central portion of the fusing roller 611.

Figure 7A:
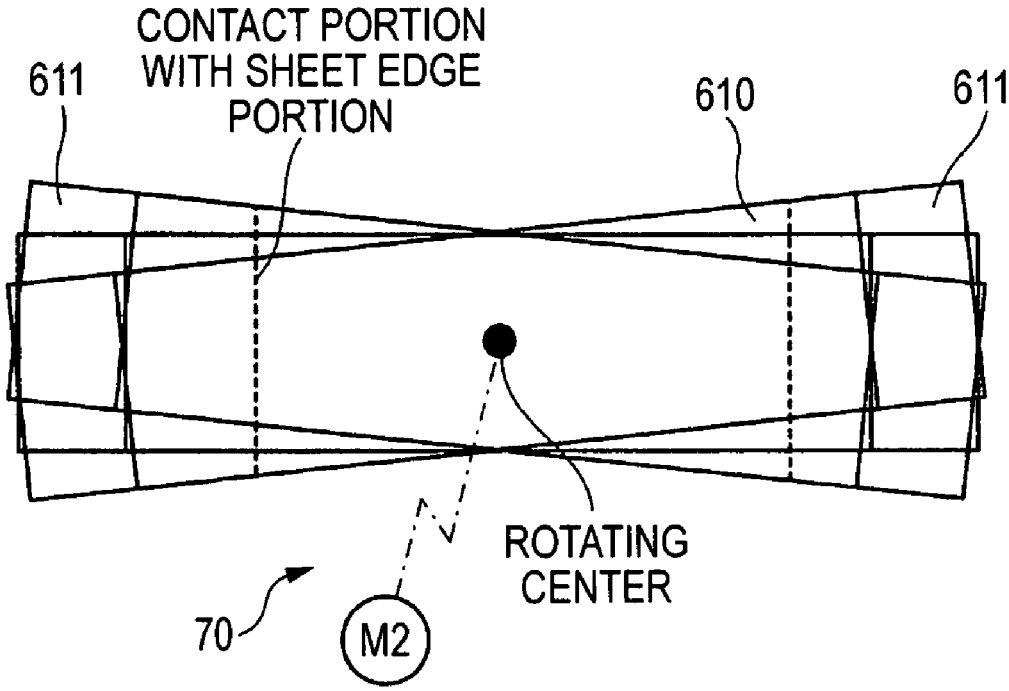
FIGS. 7A and 7B illustrate diagrams explaining marks or wear generated on the fusing belt when the fusing unit is caused to rotate substantially about a central portion of a fusing roller.
Figure 7B:
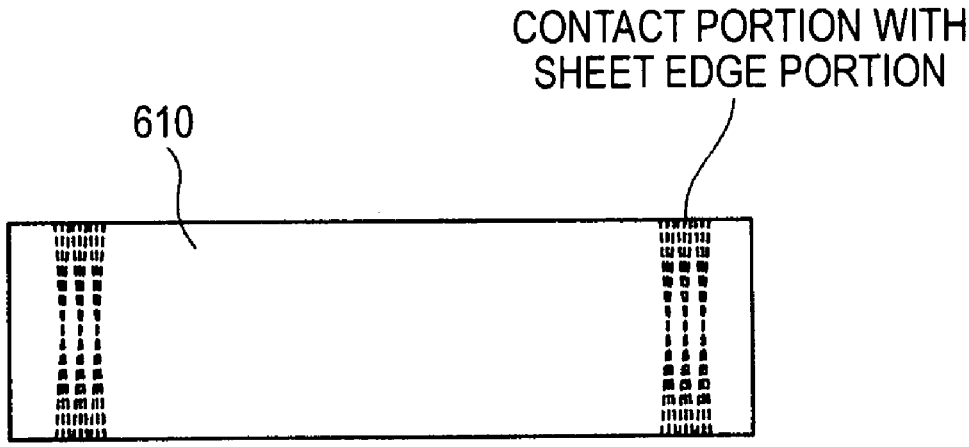

FIGS. 7A and 7B show diagrams which explain marks or the like which are generated on the fusing belt 610 when the fusing unit 60 is rotated about substantially a central portion of the fusing roller 611.

In the exemplary embodiment, as is shown in FIG. 7A, the rotating center about which the support housing 63 (refer to FIGS. 3A and 3B) rotates when it so does is provided in an axially central portion of the fusing roller 611 which lies on the axis of the fusing roller 611. In addition, in this exemplary embodiment, the support housing 63 is provided so as to rotate clockwise and counterclockwise about the rotating center. Then, the support housing 63 is rotated about the rotating center by the rotating unit 70.

FIG. 7A illustrates three modes including a state in which the fusing roller 611 (the nip section N (refer to FIGS. 3A and 3B)) is disposed in the direction which intersects the transport direction of sheets that are transported (refer to FIGS. 3A and 3B) substantially at right angles (a reference state), a state in which the fusing roller 610 is rotated (swung) clockwise about the rotating center (a non-reference state), and a state in which the fusing roller 610 is rotated (swung) counterclockwise about the rotating center (a non-reference state). In addition, looking at this from a different viewpoint, FIG. 7A illustrates a state in which the nip section N (refer to FIGS. 3A and 3B) is disposed in the direction which intersects the transport direction of sheets that are transported (refer to FIGS. 3A and 3B) substantially at right angles (a reference state) and a state in which one end side of the nip section N is moved towards or away from the transport direction of sheets, and the other end side thereof is moved away from or towards the transport direction of sheets (a non-reference state).

Then, when sheets are passed through the nip section N in these three modes, respectively, sheet edge portions come into contact with the fusing belt 610 in different positions. In addition, in this exemplary embodiment, as has been described above, the steering roller 612 (refer to FIG. 2) is provided, and the fusing belt 610 moves in the directions which intersect the rotating direction of the fusing belt 610. As a result, as is shown in FIG. 7B, a plurality of contact portions are formed where the fusing belt 610 comes into contact with the sheet edge portions. In addition, since the nip section N is disposed so as to be put in the reference state and the non-reference state, these contact portions come to intersect each other, resulting in a state where the contact portions are not disposed parallel to each other but are disposed to intersect each other.

Thus, while the example has been described in which the fusing unit 60 is rotated about the rotating center, the degree of dispersion of the contact portions comes to differ depending on the position of the rotating center. For example, in the example shown in FIGS. 6A and 6B, since the rotating center is disposed in the position of an end portion of the fusing roller 610 which is a position different from the axially central portion of the fusing roller 610 or a position which deviates from the axially central portion of the fusing roller 610, the contact portions are generated over a relatively wide range. On the other hand, as is shown in FIGS. 7A and 7B, when the rotating center is disposed in the axially central portion of the fusing roller 611, the range where the contact portions are generated is narrowed when compared with the case shown in FIGS. 6A and 6B.

Although there is a possibility that the marks or wear generated in the contact portions appears as the image defect as has been described above, the wider the range where the contact portions are generated, the wider marks or wear generated tends to be dispersed, and hence, the image defect becomes difficult to be recognized by the extent that the marks or wear is so dispersed. Because of this, the rotating center is desirably disposed in the position which deviates from the axially central portion of the fusing roller 611 as is shown in FIGS. 6A and 6B from the view point that the image defect is made difficult to be recognized by the user or the like. Note that when attempting to cause the rotating center to deviate from the axially central portion of the fusing roller 611, the rotating center can be disposed at the end portion of the fusing roller 611 as is shown in FIGS. 6A and 6B, or the rotating center can be disposed at the end portion of the steering roller 612 as is shown in FIGS. 3A and 3B. Namely, when the rotating center is disposed in the position deviating from the axially central portion of the fusing roller 611, the position where the rotating center is disposed is not limited to positions on the fusing roller 611, and hence, the rotating center can be disposed in any other position than those on the fusing roller 611.

Incidentally, the timing or the like at which the fusing unit 60 is rotated so as to put the nip section N in the reference state or the non-reference state is set by the control unit 40 based on kinds of sheets such as basic weight, thickness and the like or the number of sheets on which fusing is performed. In addition, the angle or the like through which the fusing unit 60 is rotated is also set by the control unit 40 based on kinds of sheets or the number of sheets. Hereinafter, the timing at which the nip section N is put in the reference state or the non-reference state and the rotational angle through which the fusing unit 60 is rotated will be described in detail.

For example, the shift of the nip section N from the reference state to the non-reference state can be performed when the basic weight of sheets on which fusing is performed is large. This is because the thicker a sheet or the larger the basic weight thereof, the more easily marks or wear is generated on the fusing belt 610 in general and in the event that fusing is performed without rotating the fusing unit 60, marks or wear is generated concentrically at a specific location on the fusing belt 610. Whether a sheet is thick or the basic weight is large is determined by the control unit 40 based on an input made by the user through the control panel (not shown).

Specifically speaking, the control unit 40 receives information given by the user through the control panel (not shown) as the receiving section and determines whether a sheet on which fusing is performed is thick or the basic weight thereof is large. Then, when determining that the sheet on which fusing is performed is thick or the basic weight thereof is large, the control unit 40 causes the fusing unit 60 to rotate so as to put the nip section N, which is being in the reference state, in the non-reference state.

Note that with the nip section N left in the non-reference state, when fusing is performed on a sheet which is thin or whose basic weight is small, wrinkles tend to be generated on the sheet. Because of this, when fusing is performed on a sheet which is thin or whose basic weight is small, the nip section N is desirably put back in the reference state. Namely, with a sheet which is thin or whose basic weight is small, the nip section N is desirably put in the reference state, whereas with a sheet which is thick or whose basic weight is large, the nip section N is desirably put in the non-reference state. In addition, in this exemplary embodiment, while the example is described in which whether or not the sheet is thick is determined based on information inputted through the control panel, there can be adopted a configuration in which a sensor is provided for detecting the thickness of a sheet that is supplied for fusing, so that whether or not the sheet is thick can be determined based on an output from the sensor so provided. In this case, the control unit 40 (refer to FIG. 1) functions as the receiving section.

In addition, the rotation of the fusing unit 60 can be performed based on the number of sheets on which fusing is performed. For example, when receiving an instruction to produce a plurality of printed sheets from the user via the control panel, the control unit 40 causes the fusing unit 60 to rotate so as to put the nip section N, which is being in the reference state, in the non-reference state after a predetermined number of sheets have been subjected to fusing. In addition, the control unit 40 can cause the fusing unit 60 to rotate so as to dispose the nip section N in such a manner as to increase the angle relative to the reference state after a predetermined number of sheets have been subjected to fusing. Furthermore, the control unit 40 can be configured to grasp a total number of sheets which are to be subjected to fusing so as to cause the fusing unit 60 to rotate when a predetermined number of sheets have been subjected to fusing.

In the exemplary embodiment described above, while the nip section N is put in the non-reference state by causing the fusing unit 60 to rotate, the nip section N can also be put in the non-reference state by causing a member or section provided on the main body side of the image forming apparatus such as the transport belt 55 (refer to FIG. 1). When causing the member or section provided on the main body side of the image forming apparatus to rotate, however, since there is a fear that the image forming apparatus is enlarged in size or wrinkling or jamming (wedging) is generated in the transporting process of sheets, the fusing unit 60 is preferably caused to rotate. In addition, in the embodiment, while the configuration is described in which the fusing belt 610 is used, the configuration of the embodiment can, of course, be applied, as well, to a fusing unit which adopts the so-called roll-nip method in which a pair of roller-like members are used in place of a belt-like member corresponding to the fusing belt 610. In this case, the pair of roller-like members correspond to the first fusing member and the second fusing member, respectively.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated.

It is intended that the scope of the invention be defined by the following claims and their equivalents.

What is claimed is:

1. An image forming apparatus, comprising:

a first fusing member provided rotatably;

a second fusing member disposed rotatably in press contact with the first fusing member, so as to define, together with the first fusing member therebetween, a nip section through which a recording material which holds an image thereon is to be passed;

a changing unit that changes an angle formed by the nip section and a transport direction of the recording material which is passed through the nip section; and a support member that supports the first fusing member and the second fusing member, wherein the changing unit performs a change of the angle formed by the nip section and the transport direction of the recording material by rotating the support member.

2. The image forming apparatus according to claim 1, wherein the first fusing member comprises at least a roller-like member, and wherein a rotating center about which the changing unit rotates the support member is provided in a position which deviates from an axially central portion of the roller-like member.

3. An image forming apparatus, comprising:

a first fusing member provided rotatably;

a second fusing member disposed rotatably in press contact with the first fusing member, so as to define, together with the first fusing member therebetween, a nip section through which a recording material which holds an image thereon is to be passed;

a changing unit that changes an angle formed by the nip section and a transport direction of the recording material which is passed through the nip section, wherein the changing unit changes the angle by changing positions of the first fusing member and the second fusing member; and a support member that supports the first fusing member and the second fusing member, wherein the changing unit performs a change of the angle formed by the nip section and the transport direction of the recording material by rotating the support member.

4. The image forming apparatus according to claim 3, wherein the changing unit changes the positions of the first fusing member and the second fusing member by rotating the first fusing member and the second fusing member.

5. The image forming apparatus according to claim 3, wherein the first fusing member comprises at least a roller-like member, and wherein a rotating center about which the changing unit rotates the support member is provided in a position which deviates from an axially central portion of the roller-like member.

6. An image forming apparatus, comprising:

a first fusing member provided rotatably;

a second fusing member disposed rotatably in press contact with the first fusing member, so as to define, together with the first fusing member therebetween, a nip section through which a recording material which holds an image thereon is to be passed; and a changing unit that changes an angle formed by the nip section and a transport direction of the recording material which is passed through the nip section, wherein the changing unit changes the angle based on the number of recording materials which are to be passed through the nip section or types of the recording materials.

7. The image forming apparatus according to claim 6, further comprising:

a support member that supports the first fusing member and the second fusing member, wherein the changing unit performs a change of the angle formed by the nip section and the transport direction of the recording material by rotating the support member.

8. The image forming apparatus according to claim 7, wherein the first fusing member comprises at least a roller-like member, and wherein a rotating center about which the changing unit rotates the support member is provided in a position which deviates from an axially central portion of the roller-like member.

9. An image forming apparatus, comprising:

a first fusing member that fuses an image held on a recording material;

a second fusing member disposed in press contact with the first fusing member, so as to define, together with the first fusing member therebetween, a nip section that fuses an image held on a recording material which is transported thereto on to the recording material;

a receiving section that receives information regarding a recording material on which fusing is performed at the nip section; and a swing unit that swings back and forth at least one edge side of the nip section relative to a direction in which a recording material is transported based on the information regarding the recording material which is received at the receiving section.

10. The image forming apparatus according to claim 9, further comprising:

a support member that supports the first fusing member and the second fusing member, wherein the swing unit performs a swing of the at least one edge side of the nip section by rotating the support member.

11. The image forming apparatus according to claim 10, wherein the first fusing member comprises at least a roller-like member, and wherein a rotating center about which the swing unit rotates the support member is provided in a position which deviates from an axially central portion of the roller-like member.

* * * * *